US005625971A

United States Patent [19]

Tuma et al.

[11] Patent Number: 5,625,971

[45] Date of Patent: May 6, 1997

[54] HANDGUN

[75] Inventors: Martin Tuma, Allmendstrasse 31 B, 4503 Solothurn; Vaclav Brunclik, Lättenstrasse 106, 8142 Uitikon, both of Switzerland

[73] Assignees: Martin Tuma; Vaclav Brunclik

[21] Appl. No.: 550,684

[22] Filed: Oct. 31, 1995

[51] Int. Cl.[6] ..... F41A 17/24

[52] U.S. Cl. ..... 42/70.08; 42/70.01

[58] Field of Search ..... 42/70.01, 70.08, 42/69.03, 70.05

[56] References Cited

U.S. PATENT DOCUMENTS

| | | | |
|---|---|---|---|
| 2,856,717 | 10/1958 | Parke | 42/70.01 |
| 3,184,876 | 5/1965 | Walther | 42/70.08 |
| 4,555,861 | 12/1985 | Khoury | 42/70.08 |
| 4,843,748 | 7/1989 | Tuma | 42/70.08 |
| 4,926,574 | 5/1990 | Rieger | 42/70.08 |
| 5,303,494 | 4/1994 | Tuma | 42/70.04 |
| 5,437,120 | 8/1995 | Dornaus | 42/70.08 |

*Primary Examiner*—Michael J. Carone
*Assistant Examiner*—Theresa M. Wesson
*Attorney, Agent, or Firm*—Ladas & Parry

[57] ABSTRACT

The sear includes a first tang adapted to cooperate with the searing surface of the hammer. A second tang of the sear projects towards the firing pin. The firing pin has a sleeve like portion of an increased diameter defining an abutment surface. In the cocked position of the hammer the first tang of the sear contacts the searing surface of the hammer, and the end of the second tang is located in front of the abutment surface of the firing pin. Thus, when the gun is accidentally dropped, the firing pin cannot move for instance due to forces of intertia units own into the firing position striking unintentionally a loaded round.

5 Claims, 5 Drawing Sheets

HANDGUN

BACKGROUND OF THE INVENTION

1. Field of the Invention

The present invention relates to a handgun, having a frame, a firing pin which is moveable between a rest position and firing position, a barrel mounted upon the frame, a slide for sliding reciprocating movement on said frame, a trigger pivotally mounted upon the frame by a trigger pin, a trigger rod member pivotally connected to the trigger by means of a pin and having a control surface, a spring loaded sear pivotally mounted upon the frame by means of a sear pin, a hammer pivotally mounted to the frame by means of a hammer pin, a hammer rod spring acting onto the hammer, which hammer includes a searing surface and a half-cocked notch, which sear includes a first tang for engaging the searing surface of the hammer, and includes a control projection for engaging the control surface of the trigger rod member, which sear is rotatable between a hammer locking position and a hammer release position, and having a pivotable decocking control device supported at the frame by means of a control device shaft member and having a control member adapted to cooperate with the sear and the hammer for a decocking of the gun.

2. Description of the Prior Art

Such guns are generally known as semiautomatic pistols which can be fired in a single action mode and in a double action mode, as well.

Such guns should lend themselves to be fired quickly and accurately. Further, they should lend themselves for a safe operation because faulty manipulations, for instance, under stress can lead to an accidental firing of the gun. Such an accidental firing of the gun due to a faulty manipulation can occur when decocking the gun. A decocking of a cocked gun is accomplished generally, in that the operator pulls the trigger slightly and simultaneously holds the hammer with this thumb to slowly move the hammer into the decocked position. The hammer can slip off the thumb such that accidentally a shot is fired.

A further accidental firing of the gun can occur when the gun is dropped on the ground because in certain positions moments of inertion could propel the firing pin against a loaded round initiating an accidental firing of the gun.

SUMMARY OF THE INVENTION

It is a general object of the present invention to provide a hand gun having simple and safely operating structures for preventing an accidental firing of the gun.

A further object is to provide a hand gun, in which the sear comprises a second tang and the firing pin comprises an abutment surface, which second tang is adapted to be positioned upon a rotational movement of the sear in front of the abutment surface of the firing pin preventing its movement from its rest position into its firing position.

The advantages gained by the invention can be seen specifically in that a safe decocking of the hammer is possible without contacting the trigger with the finger and that also one single structural member needed for the operation of the gun, namely the sear is additionally used to directly block the firing pin and thus to prevent a firing of the gun when it accidentally is dropped.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
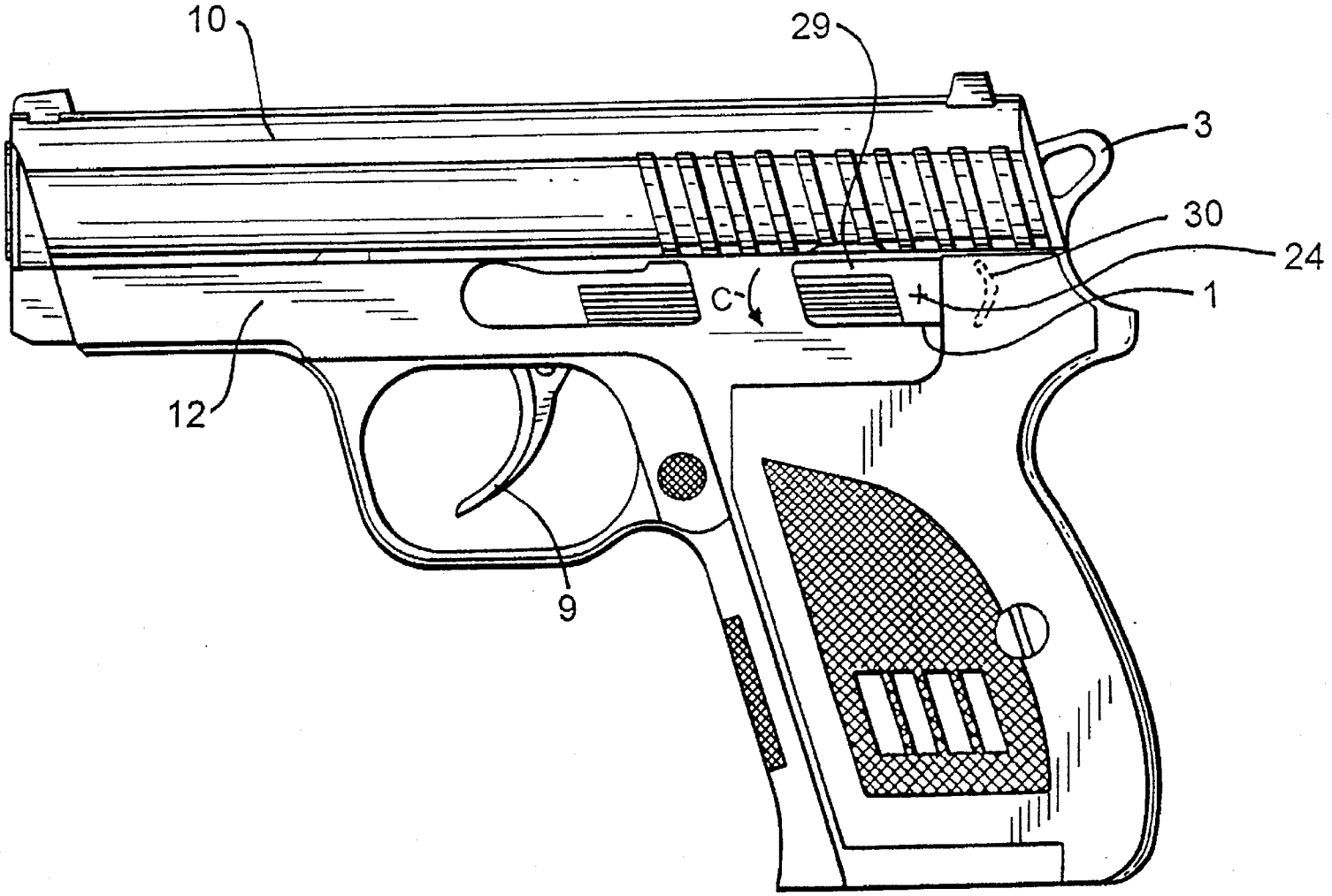
FIG. 1 is a side view of a hand gun.
Figure 3:
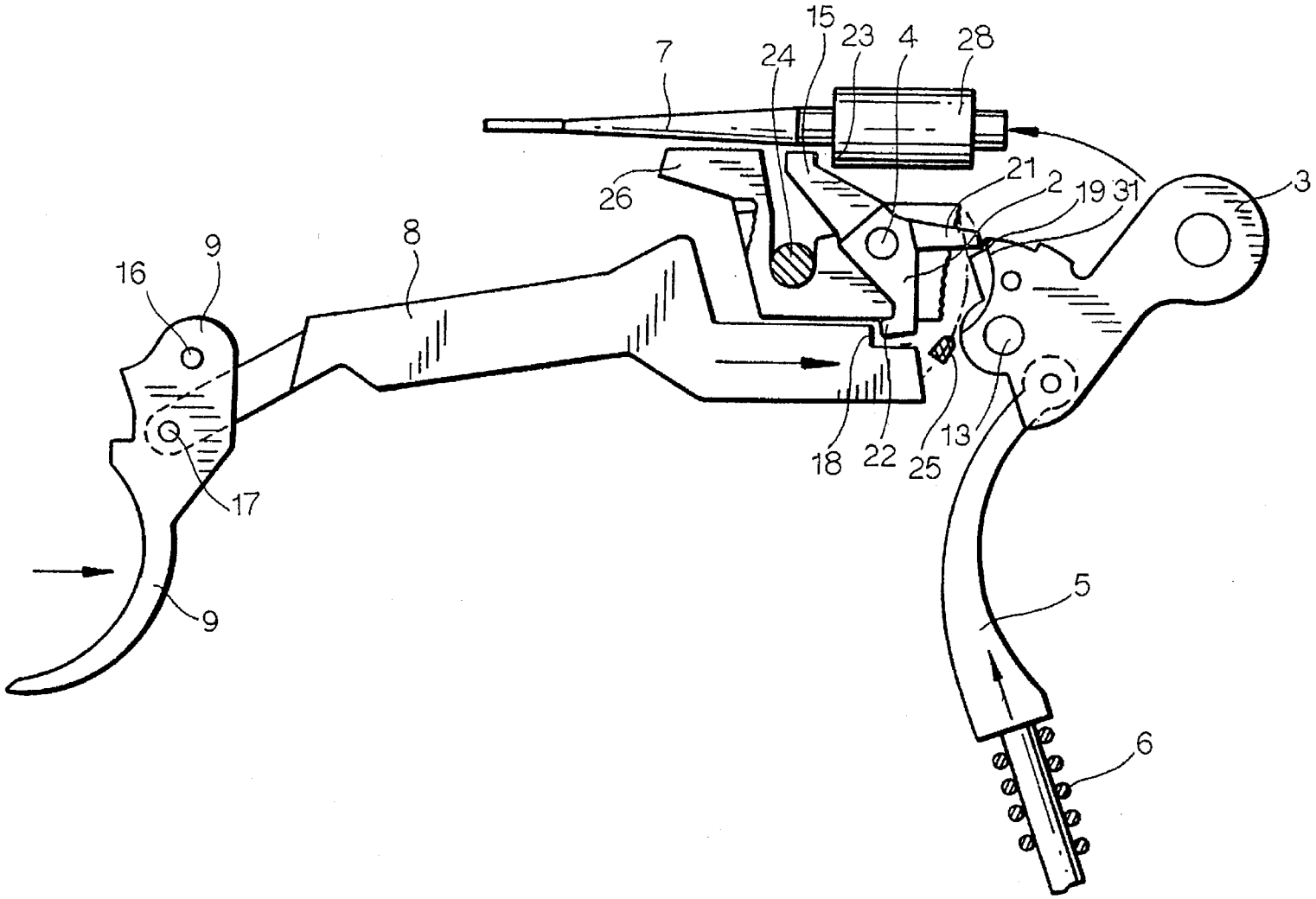
FIG. 3 is a schematic view of the main operating members of the hand gun illustrated in FIG. 1, on a somewhat enlarged scale.
Figure 5:
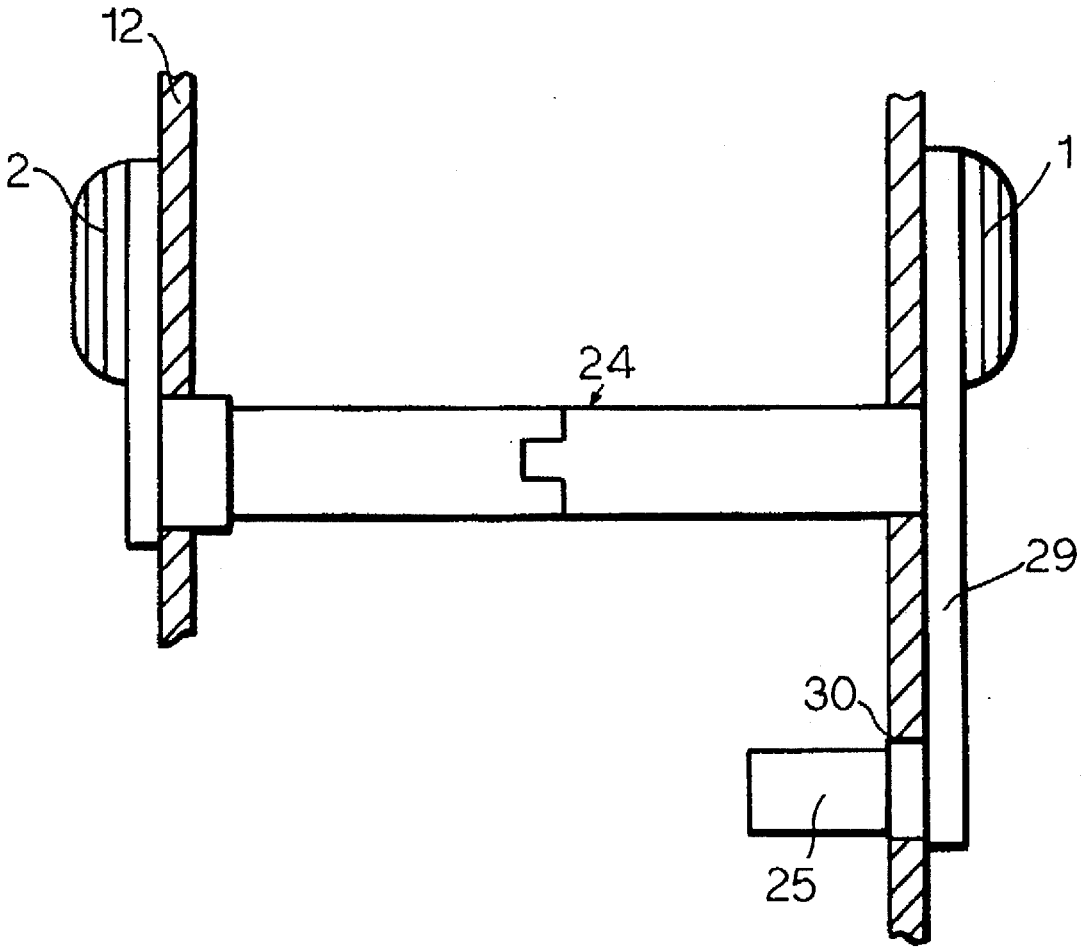
FIG. 5 is a view of the decocking control device of the hand gun.

The semiautomatic pistol illustrated in the figures includes a frame 12, a trigger 9, a slide 10 mounted for reciprocating movement on the frame 12 and a hammer 3. Reference numeral 1 denotes a decocking lever of the decocking control device. The decocking lever 1 can be depressed by means e.g. of the thumb to rotate in the direction of the arrow C in FIG. 1. It can, thereby, be moved between two positions. The resting in these positions can be accomplished, for instance, by a notch as obvious for the person skilled in the art. The operating lever 1 can be rotated around a shaft member 24, of which the central line is also illustrated in FIG. 1. When the lever 1 is depressed in direction of the arrow C, the oppositely located arm 29 (FIG. 5) moves upwards due to the rotation around the shaft member 24. Also illustrated in FIG. 5 is the location of a control member 25 which will be explained more in detail further below. This control member 25 has a peg like shape and projects from the arm 29 into the inside of the frame 12. Accordingly, such as illustrated in FIG. 1, the frame 12 includes a curvilinear slot 30, through which slot the peg-shaped control member projects into the inside of the frame 10. Reference numeral 24 in FIG. 3 illustrates in section the location of the shaft member, i.e. the location of its center axis, around which the operating lever 1 and arm 29, respectively, may be rotated.

Figure 2:
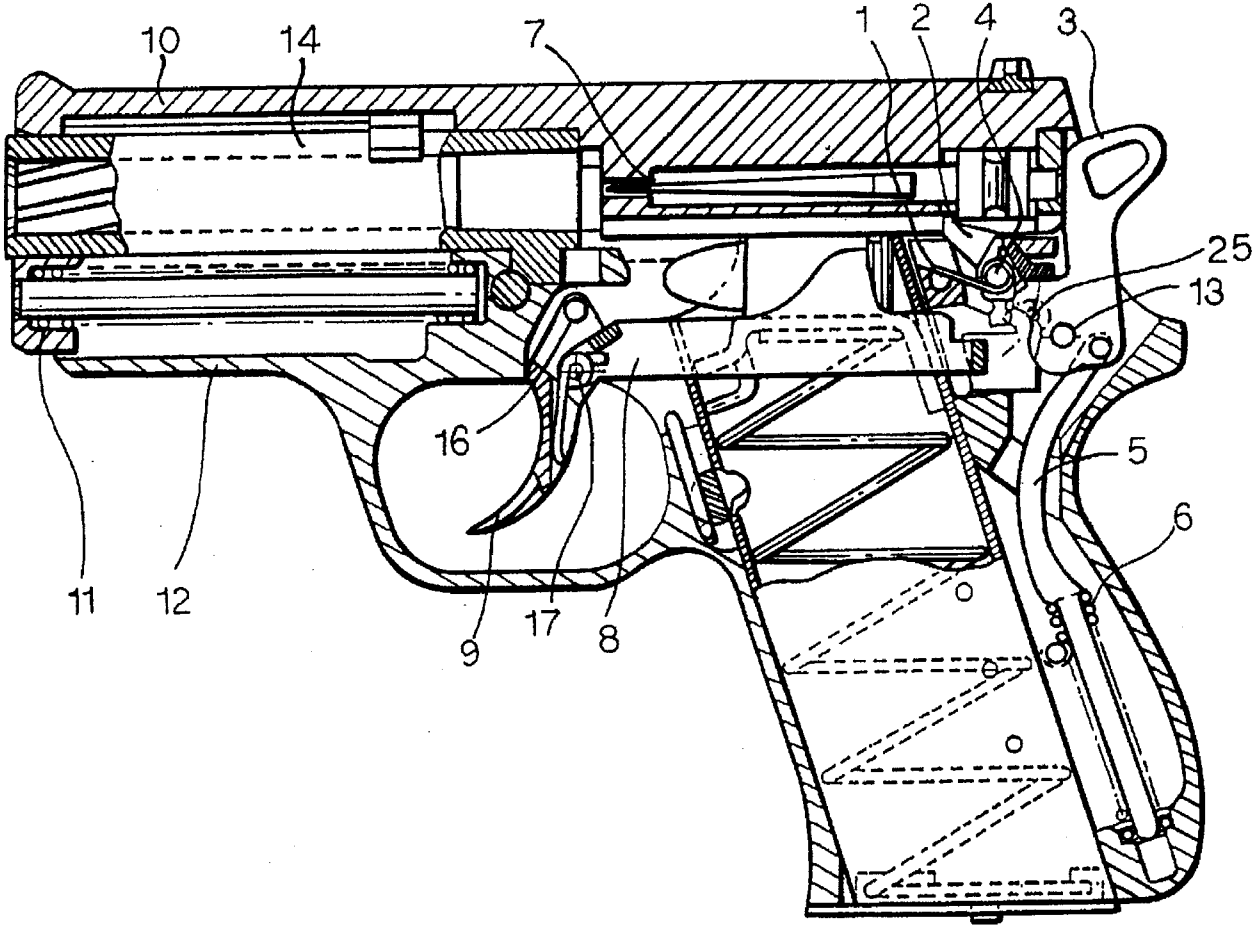
FIG. 2 is a section through the hand gun of FIG. 1.

The pistol or handgun, respectively, as illustrated in FIG. 2, has a frame 12, a barrel 14 mounted on the frame, a slide 10 mounted for sliding reciprocating movement on the frame 12 and a recoil spring 11. A trigger 9 is pivotally mounted upon the frame 12 by a trigger pin 16o A trigger rod member 8 is pivotally connected to the trigger 9 by means of a pin 17.

The pistol includes, furthermore, a sear 2, hammer 3, ejector 26 and firing pin 7. Reference numeral 4 identifies the sear pin, around which the sear 2 rotates. The hammer 3 is pivotally connected to a hammer rod 5 subjected to the biassing force of the hammer spring 6. The hammer 3 is pivotally mounted to the frame by means of the hammer pin 13.

This structural elements are generally known and in this respect reference is made to the U.S. Pat. No. 4,843,748; U.S. Pat. No. 4,980,163; U.S. Pat. No. 5,000,075 and U.S. Pat. No. 5,303,494.

Reference is now made to FIG. 5 illustrating the decocking control device on a somewhat enlarged scale. The control device shaft member 24 is rotatably supported in the frame 12 of the gun. It carries at the outside of the frame 12 a right-hand operating lever 1 and, in this embodiment also a left-hand operating lever 2. Accordingly, it must be noted that this device is suitable for left-handed and right-handed person or, can be operated at the right-hand side or at the left-hand side of the gun, which reduces the possibilities of faulty operations. It can be seen from FIG. 5 that the shaft member 24 is made of two parts which can be mounted from the right-hand side and from the left-hand side through the frame 12 and connected therewithin by any known structuring. The shaft member 24 carries at its right side at the outer side of the frame 12 an arm 29. This arm 29 supports in turn a peg shaped control member 25 projecting through the curvilinear slot 30 into the interior of the frame 12.

Accordingly, when e.g. the operating lever member 1 is depressed, the shaft member 24 is caused to rotate such that the control member 25 will move upwards along a circular line around the center axis of the shaft member (see also FIG. 3).

The trigger 9 is pivotally mounted to the frame 12 by the trigger pin 16. The trigger rod member 8 (which, as generally known, can be a frame or bracket like structure) is pivotally connected to the trigger 9 by means of the pin 17. At its opposite side the trigger rod member 8 includes a control surface 18.

The spring loaded sear 2 is pivotally mounted upon the frame 12 by means of the sear pin 4. The sear 2 includes specifically a first tang 21, a second tang 15 and a control projection 22 located opposite the control surface 18 of the trigger rod 8.

Reference numeral 26 identifies the ejector.

The hammer 3 is pivotally mounted to the frame 12 by means of the hammer pin 13. This hammer 3 includes a searing surface 19 located opposite the first tang 21 of the sear 2 and, furthermore, a half-cocked notch 20 located somewhat behind the searing surface 18. The hammer 3 includes, furthermore, contiguous with the searing surface 19 a decocking control cam surface 31.

The hammer 3 is pivotally mounted to a hammer stud rod 5 which is acted upon by a hammer rod spring 6 in a known manner.

The second tang 15 of the sear 2 projects towards the firing pin 7. The firing pin 7 has a sleeve like portion 28 of an increased diameter, such that an abutment surface 23 is formed on the firing pin 7.

When the sear 2 is in its locking position as illustrated in FIG. 3 its second tang 15 is located in front of the abutment surface 23 of the firing pin 7. Thus, the movement of the firing pin 7 from its rest position into its firing position is positively prevented because the end of the second tang 15 is located in the path of movement of mentioned abutment surface 23 from the rest position into the firing position, such that e.g. in case of the gun being e.g. accidentally dropped onto the ground the firing pin 7 can impossibly move into its firing position due to forces of inertia.

Figure 4:
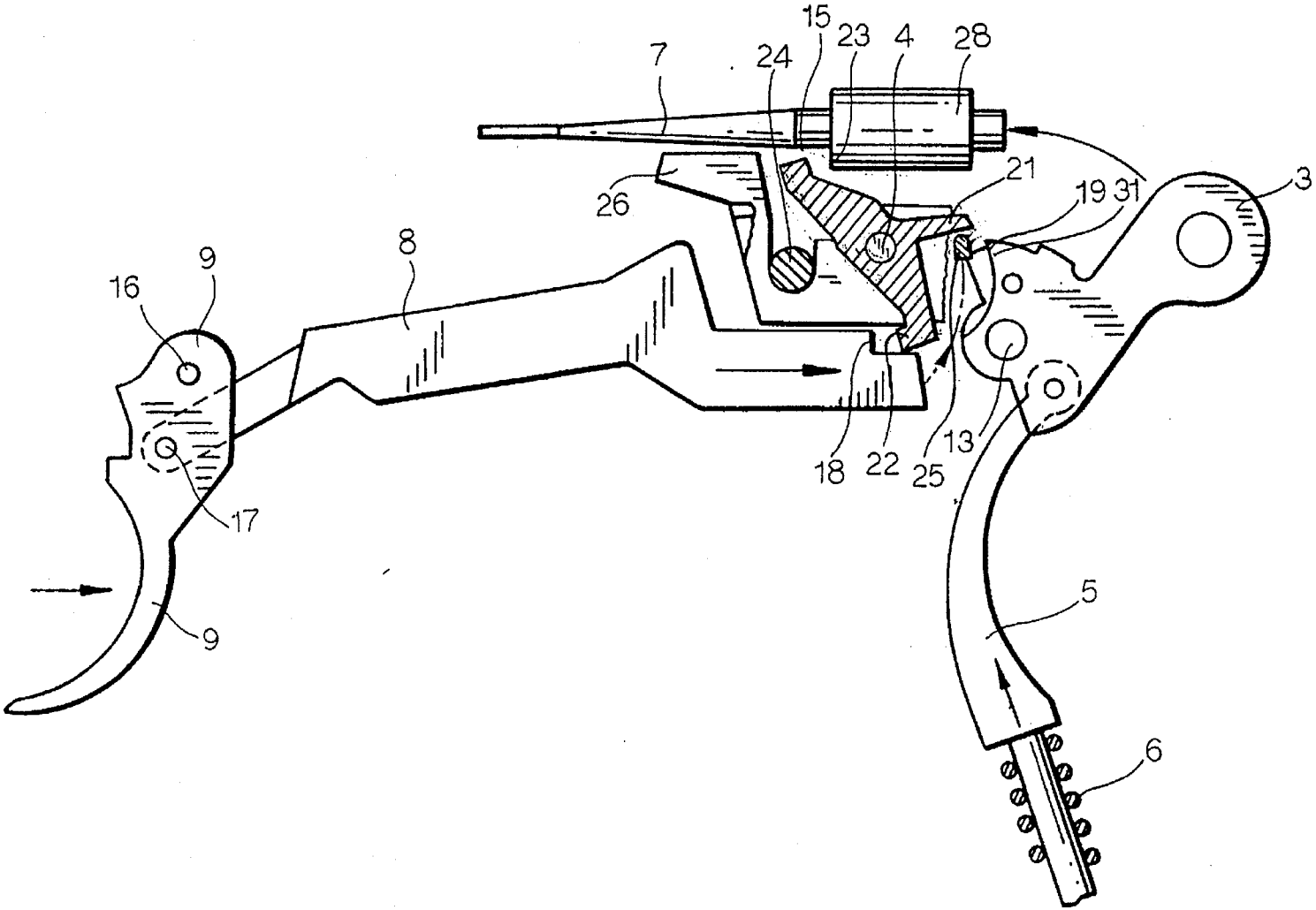
FIG. 4 is a view similar to FIG. 3, whereby the sear is illustrated in section.

The decocking device is illustrated in FIG. 3 and 4 merely by its shaft member 24 and its control member 25. When the shaft 24 is rotated, the control member 25 moves along the dash-dotted curvilinear line illustrated in FIGS. 3 and 4.

The operation of this gun proceeds as follows. In order to initially load a round into the chamber the slide 10 is manually pulled back. The slide 10 moving backwards causes the hammer 3 to rotate counterclockwise around the hammer pin 13 into the position "cocked". In this position the hammer 3, biased by the hammer rod spring 6, rests at its searing surface 19 against the first tang 21 of the sear (see FIG. 3). The recoil spring 11 causes the slide 10 to move again forward into its original position and simultaneously a round is loaded from the magazine into the chamber of the barrel 14. The gun is now cocked, ready for firing.

In order to fire the gun the trigger is pulled such that the trigger rod 8 is pushed back. The control surface 18 of the trigger rod 8 contacts the control projection 22 of the sear 3 causing the sear 2 to rotate counter-clockwise around the sear pin 4. Accordingly, the first tang 21 pivots upwards and off the searing surface 19 of the hammer 4. The second tang 15 rotates downwards and away from the abutment surface 23 of the firing pin 7, such that the firing pin 7 is now free to move from its rest position into its firing position. The hammer 3, biased by the hammer rod spring 6 acting onto the hammer rod stud 5 rotates clockwise around the hammer pin 13 and strikes the firing pin 7 which in turn strikes the end of the chambered round. A shot is fired and the gas pressure causes the slide 10 to recoil backwards, causing the hammer 3 to be cocked again an a loading of the next round into the chamber.

Next, the decocking will be described. The procedure proceeds from the cocked state of the gun as illustrated in FIG. 3. The first tang 21 of the sear 2 rests against the searing surface 19 of the hammer 3.

The task is now to decock the hammer 3 without touching or operating the hammer 3 or the trigger 9. The operating lever 1 (or 27) is pivoted downwards into the lower position "decock". The control member 25, see FIG. 4, rotates around the center axis of the shaft 24 of the decocking control device. It is hereby to be noted, that this control member 25, i.e. the peg, can be located at the left-hand side or at the right-hand side of the decocking control device or even at both sides thereof.

When depressing the operating lever 1 the control member 25 pivots upwards to contact the lower surface of the first tang 21 of the sear 2 and accordingly rotates it upwards, such as illustrated in FIG. 4. The first tang 21 leaves accordingly the searing surface 19 of the hammer 3 and the hammer 3 can begin to rotate clockwise around the hammer pin 13 due to the biasing force of the hammer rod spring 6. Simultaneously, the control member 25 comes to contact and rest against the decocking control cam surface 31 of the hammer 3 because this control cam surface 31 moves towards the control member 25 due to mentioned pivoting movement of the hammer 3. Accordingly, the control member 25 breaks and decelerates the pivoting movement of the hammer 3 in the clockwise direction and under the influence of the force exerted by the hammer 3 via the control cam surface 31 slides slowly down the decocking control cam surface 31. The decocking control device pivots into its rest position. At the same time, the sear 2 is caused to rotate by its biassing spring back around the sear pin 4 such that its first tang comes to contact either the half-cocked notch 20 or 21 of the hammer 4, or slides thereover for a complete decocking of the hammer 3.

In summarizing, when the hammer 3 is cocked, the operator can push the operating lever 1 from its upper position downwards to automatically decock the hammer 3. Then, due to the frictional engagement between control member 25 and the decocking control cam surface 31 the hammer 3 pivots slowly into its decocked position. Further, as long as the trigger 9 is not pulled, the second tang 15 is located in the path of movement of the firing pin 7, namely in front of its abutment surface 23.

While there is shown and described a present preferred embodiment of the invention, it is to be distinctly understood that the invention is not limited thereto, but may be otherwise variously embodied and practiced within the scope of the following claims.

We claim:

1. A handgun, having a frame, a firing pin which is moveable between a rest position and a firing position, a barrel mounted upon the frame, a slide for sliding reciprocating movement on the frame, a trigger pivotally mounted upon the frame by a trigger pin, a trigger rod member pivotally connected to the trigger by means of a pin and having a control surface, a spring loaded sear pivotally mounted upon the frame by means of a sear pin, a hammer pivotally mounted to the frame by means of a hammer pin, a hammer rod spring acting onto the hammer, which hammer includes a searing surface and a half-cocked notch, which sear includes a first tang for engaging the searing surface of the hammer and a control projection for engaging the control surface of the trigger rod member, which sear is totatable between a hammer locking position and a hammer release position, and having a pivotable decocking control device supported at the frame by means of a control device shaft member and having a control member adapted to cooperate with the sear and the hammer for a decocking of the gun, said sear comprising a second tang and said firing pin comprising an abutment surface, which second tang is adapted to be positioned upon a rotational movement of the sear in front of the abutment surface of the firing pin preventing its movement from its rest position into its firing position.

2. The handgun of claim 1, in which the control member is arranged for movement into and out of contact with the first tang of the sear, further in which the decocking control device is rotatable between a firing position and a decocking position; whereby in the firing position of the decocking control device its control member is at a distance from the first tang of the sear allowing a trigger rod member initiated movement thereof into its hammer release position, and in the decocking position of the decocking control device its control member contacts the first tang of the sear to move if away from the searing surface of the hammer.

3. The handgun of claim 2, in which the hammer includes a decocking control cam surface located adjacent its searing surface in such a manner that the control member of the decocking control device in its decocking position contacts the decocking control cam surface, whereby the hammer rod spring initiated movement of the hammer towards its decocked position forces the control member to move along the decocking control cam surface and thus to return the decocking control device into its firing position.

4. The handgun of claim 3, in which the decocking control cam surface is a concavely extending surface area of the hammer and is frictionally engaged by the control member of the decocking control device in the decocking position, and in that the spring force of the hammer rod spring, the curvature of the decocking control cam surface and the coefficient of friction between the decocking control cam surface and the control member are selected in such a manner that the decocking movement of the hammer proceeds at a controlled slow speed.

5. The handgun of claim 4, in which the decocking control device comprises a shaft member supported for rotation in the frame and mounted at least one of its ends to a respective operating lever member arranged at the respective outer side of the frame, further in which the operating lever member includes an arm extending along the outer side of the frame and mounted to the peg shaped control member projecting through a curvilinear slot in the frame into its interior.

* * * * *